United States Patent [19]

Serrander

[11] 4,237,337

[45] Dec. 2, 1980

[54] CABLE WITH WIRE FOR SLITTING A PROTECTIVE SHEATH AND PROCESS OF MANUFACTURING SAME

[75] Inventor: Hans R. Serrander, Johanneshov, Sweden

[73] Assignee: Telefonaktiebolaget L M Ericsson, Stockholm, Sweden

[21] Appl. No.: 911,489

[22] Filed: Jun. 1, 1978

[30] Foreign Application Priority Data

Jun. 9, 1977 [SE] Sweden ..... 7706752

[51] Int. Cl.[3] ..... H01B 7/00; H01B 13/14

[52] U.S. Cl. ..... 174/70 R; 156/51; 174/10; 206/616

[58] Field of Search ..... 174/10, 68 C, 70 R, 174/115, 116; 206/616; 156/47, 51

[56] References Cited

U.S. PATENT DOCUMENTS

| | | | |
|---|---|---|---|
| 2,090,747 | 8/1937 | Charmoy | 174/10 X |
| 2,147,337 | 2/1939 | Charmoy | 174/10 X |
| 2,750,437 | 6/1956 | Olson et al. | 174/110 R |
| 3,092,251 | 6/1963 | Jaggers | 206/616 X |
| 3,338,404 | 8/1967 | Becker et al. | 206/616 X |
| 3,426,936 | 2/1969 | Palmer | 206/616 X |
| 3,494,538 | 2/1970 | Matthews | 206/616 X |
| 3,748,371 | 7/1973 | Krook et al. | 174/10 X |
| 3,812,282 | 5/1974 | Johansson | 174/10 X |
| 4,038,489 | 7/1977 | Stenson et al. | 174/10 X |
| 4,041,237 | 8/1977 | Stine et al. | 174/115 |

FOREIGN PATENT DOCUMENTS

| | | | |
|---|---|---|---|
| 1048619 | 1/1959 | Fed. Rep. of Germany | 174/10 |
| 420885 | of 1935 | United Kingdom | 174/10 |
| 457578 | 12/1936 | United Kingdom | 174/10 |
| 1371479 | 10/1974 | United Kingdom | 174/115 |

*Primary Examiner*—Laramie E. Askin

*Attorney, Agent, or Firm*—Hane, Roberts, Spiecens & Cohen

[57] ABSTRACT

A cable having an outer protective covering or sheath enclosing one or more insulated conductors and a cutting wire or rip cord intended for slitting the sheath, the cutting wire being attached to the sheath's inner surface and/or the core in order to prevent the cutting wire from slipping out of the cable.

8 Claims, 1 Drawing Figure

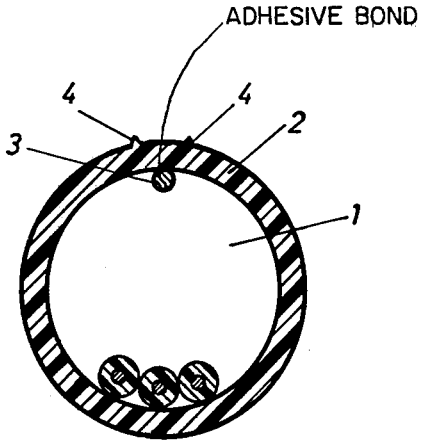
ADHESIVE BOND
4
4
2
3
1

CABLE WITH WIRE FOR SLITTING A PROTECTIVE SHEATH AND PROCESS OF MANUFACTURING SAME

FIELD OF THE INVENTION

The present invention relates to a cable containing a wire for slitting a protective sheath.

BACKGROUND

When connecting or joining cables, a larger or smaller section of the core must be uncovered. Since the unsheathing is a difficult operation which in most cases requires special tools, cables have been developed in which a cutting wire is placed in the cable core close to the sheath, which cutting wire is intended to be used as a cutting means during the unsheathing.

However, cables with cutting wires have the disadvantage that, in case the cables are short, the cutting wire has a tendency to slip out of the cable as the wire is subjected to traction during the moment of cutting. In order to reduce the force necessary to effect the cutting and thereby the risk of having the cutting wire slip out of the cable, the sheath has been provided with a part that is thinner than the rest of the sheath, which thinner part is formed by providing a longitudinal notch in the inner and/or the outer surface of the sheath. The sheath is intended to be cut up along this thinner part. This construction considerably reduces the slip-out tendency but, by using such cables, serious problems have been created with the sheath since, in bent sections of such cables, the sheath will have a tendency to burst along the notch, particularly if the cable is handled in a cold state.

SUMMARY OF THE INVENTION

An object of the present invention is to provide a cable with a cutting wire which makes the sheath-cutting of short cable lengths possible without letting the wire slip out of the cable and which simultaneously eliminates or minimizes the need for producing a thinner part of the sheath. This is achieved, according to the invention, by attaching the cutting wire to the inner surface of the sheath and/or the core.

BRIEF DESCRIPTION OF THE DRAWING

The sole FIGURE of the drawing is a cross-section taken through a cable according to the invention.

DETAILED DESCRIPTION

The cable comprises a core 1, consisting of one or more individually insulated conductors. The core is surrounded by a sheath 2, usually made of plastic material. Under the sheath 2 a cutting wire 3 is placed which is adhered to the inner surface of the sheath. In order to make the cutting wire adhere to the sheath, the wire has been lined or impregnated with an adhesive of a type that only adheres in a heated state, a so called melting-glue. When during the manufacture of the cable, the thus prepared cutting wire comes into contact with the hot plastic sheath in the hot extruder head, the adhesive becomes active and the wire adheres to the inner surface of the sheath. When the sheath has cooled, the bonding between the wire and sheath remains, whereas the adhesive in other respects has no adhesive capability.

For the unsheathing of a cable, the sheath at the cable's end will be cut with a cutting tool to such an extent that it is possible to grasp the cutting wire. In order to make it easier to determine the position of the cutting wire, the outer surface of the sheath is provided with two longitudinal ridges 4, between which the cutting wire is placed inside the sheath. Due to the fact that the adhesive has no adhesive capability in a cold state, it will not stick to tools or the hands of the user and thus will not be a disturbing factor in connection or joining operations.

With the cable according to the present invention, the need for portions of reduced thickness of the sheath and thereby the risk of cracks in the sheath, has been eliminated while simultaneously the cutting of sheaths to the very end has been made possible.

I claim:

1. A cable comprising a core having at least one individually insulated conductor, an outer sheathing on said core, a wire for tearing the outer sheathing, said wire being interposed between the inner surface of the sheathing and the outer surface of the core, and an adhesive means joining said wire to at least one of said surfaces; the sheathing being substantially uniform in thickness throughout its extent inclusive of the location of said wire.

2. A cable as claimed in claim 1 wherein said adhesive means comprises an adhesive which becomes adherent in a heated state.

3. A cable as claimed in claim 2 wherein said wire is entirely encased under said sheathing and said sheathing includes means on the outer surface thereof for indicating the location of the wire beneath the sheathing.

4. A cable as claimed in claim 3 wherein the location indicating means on the sheathing comprises a pair of longitudinally extending, spaced, projecting ridges between which said wire extends.

5. A cable as claimed in claim 1 wherein said wire is pervious to said adhesive means and said adhesive means extends into said wire.

6. A process of manufacturing a cable comprising mounting a tear wire on a core having at least one individually insulated conductor therein, applying a heat-sensitive adhesive to said wire, applying an outer sheathing onto said core and wire in a heated condition to render the adhesive adherent to cause the wire to be adhered at least to one of the inner surface of the sheathing and the outer surface of the core, and allowing the sheathing and adhesive to cool whereupon the wire is bonded in the cable by the adhesive, and the cooled adhesive no longer has adhesive capability apart from the bonding of the wire in the cable.

7. A process as claimed in claim 6 wherein said heat-sensitive adhesive is applied to said wire before the wire is mounted on said core.

8. A process as claimed in claim 7 wherein said wire is pervious to said heat-sensitive adhesive and said adhesive impregnates said wire.

* * * * *